US011276379B2

(12) United States Patent
Berent

(10) Patent No.: US 11,276,379 B2
(45) Date of Patent: Mar. 15, 2022

(54) RETAINING DEVICE FOR A CHIN REST FOR A STRINGED INSTRUMENT

(71) Applicant: GUSTAV PIRAZZI & COMP. GMBH & CO. KG, Offenbach (DE)

(72) Inventor: Korfker Berent, London (GB)

(73) Assignee: GUSTAV PIRAZZI & COMP. GMBH & CO. KG, Offenbach (DE)

( * ) Notice: Subject to any disclaimer, the term of this patent is extended or adjusted under 35 U.S.C. 154(b) by 0 days.

(21) Appl. No.: 17/041,126

(22) PCT Filed: Mar. 19, 2019

(86) PCT No.: PCT/EP2019/056765

§ 371 (c)(1),
(2) Date: Sep. 24, 2020

(87) PCT Pub. No.: WO2019/185396

PCT Pub. Date: Oct. 3, 2019

(65) Prior Publication Data

US 2021/0118414 A1 Apr. 22, 2021

(30) Foreign Application Priority Data

Mar. 26, 2018 (EP) ..... 18164042

(51) Int. Cl.
*G10D 3/18* (2020.01)

(52) U.S. Cl.
CPC ..... *G10D 3/18* (2013.01)

(58) Field of Classification Search
CPC ..... G10D 3/00; G10D 3/18
See application file for complete search history.

(56) References Cited

U.S. PATENT DOCUMENTS 775,465 A 11/1904 Becker
4,534,259 A * 8/1985 Wolf ..... G10D 3/18 84/279
9,153,214 B2 * 10/2015 Korfker ..... G10D 3/18

FOREIGN PATENT DOCUMENTS

DE 345921 C 5/1918
DE 4137917 A1 4/1992

* cited by examiner

*Primary Examiner* — Kimberly R Lockett
(74) *Attorney, Agent, or Firm* — Maschoff Brennan

(57) ABSTRACT

A holding device for a chin rest for a string instrument, by means of which a support plate provided for supporting the chin of the player of the string instrument can be connected to the body of the string instrument, is intended on the one hand to enable an ergonomically improved posture of the player and on the other hand to improve the sound of the string instrument. For this purpose, the holding device is designed as a spring element which connects the support plate to the body in a spring-loaded manner.

19 Claims, 7 Drawing Sheets

RETAINING DEVICE FOR A CHIN REST FOR A STRINGED INSTRUMENT

Figure 1:
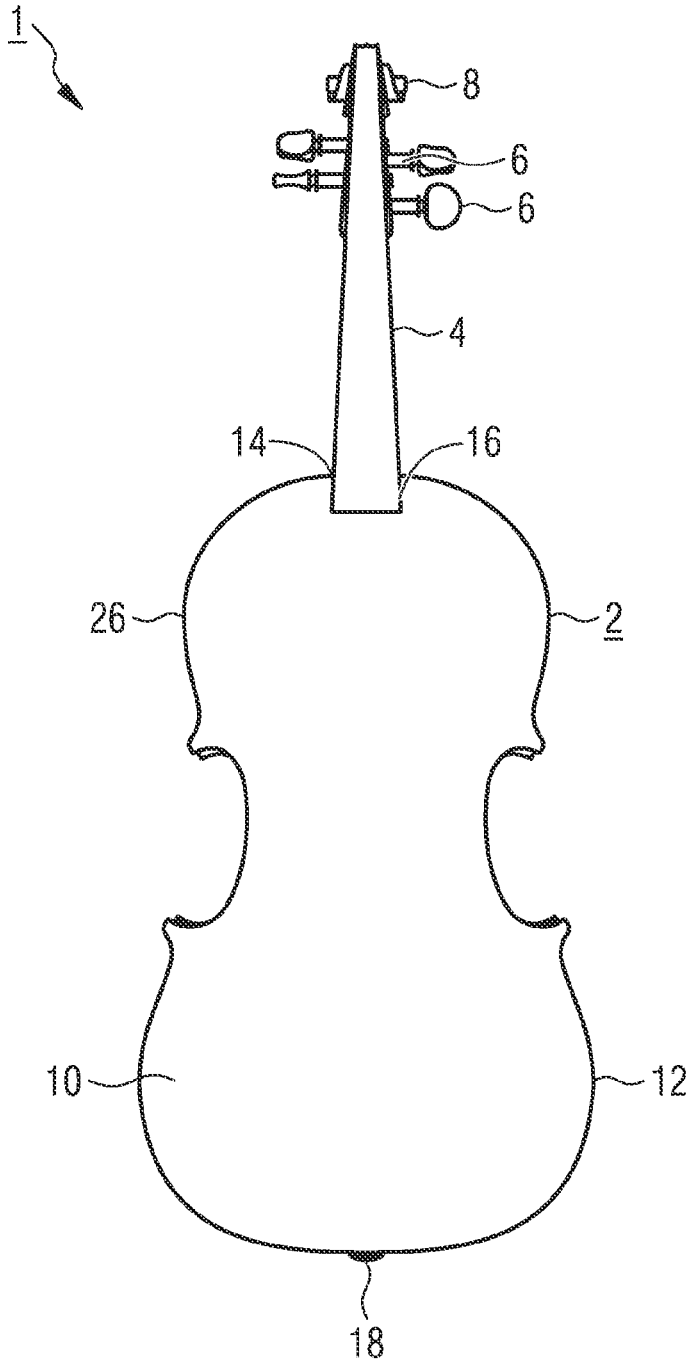

The invention relates to a holding device for a chin rest for a string instrument, by means of which a support plate intended for resting the chin of the player of the string instrument can be connected to the body of the string instrument.

Many string instruments, especially violins and violas, are held between the chin and the shoulder of the musician at the end of the body facing the player's body when playing music. However, since the distance between the player's head and the shoulder area is usually greater than the thickness of the instrument, holding or clamping the instrument is only possible for the musician in a very uncomfortable position, so that—if it is possible to play the instrument at all—impairments to the quality of playing cannot be avoided. To counteract this, so-called chin rests and shoulder rests for violins and violas have been developed.

The chin rest consists of a concave support element (or support plate), usually made of ebony or other hardwoods, which allows the player—often in combination with a shoulder rest—to hold the instrument securely and comfortably by applying chin and shoulder pressure without the sound development being impaired too much by touching the top of the instrument. Due to the individual shape of the human chin and jawbone, differently shaped, very flat to strongly recessed forms are used for the support element.

The bearing surface is usually attached to the top of the instrument, just above or to the left of the tailpiece, using a holding device. For this purpose, the holding device has corresponding connecting elements to the string instrument and the bearing surface.

Common holding devices today are e.g. metallic struts with screw connections for the bearing surface and for connection with clamps attached to the string instrument.

The chin rest should above all provide a certain stability, but on the other hand should not negatively influence the sound of the instrument. Players of all levels, however, often find that they clamp the string instrument too tightly between their shoulder or collarbone and chin. This leads to cramps and even possible injuries and possibly a poorer sound of the instrument. In general, it can be said that every chin rest influences the tone of the violin. Therefore, not only well-fitting chin rests are sought after, but especially those that have the least negative effect on the tone.

It is therefore an object of the present invention to provide a holding device of the type mentioned above, which on the one hand enables an ergonomically improved posture of the player and on the other hand improves the sound of the string instrument.

According to the invention, this object is achieved by designing the holding device for a resilient connection of the support plate with the body.

The invention is based on the consideration that an ergonomically improved posture of the player could be achieved by the player exerting less pressure on the contact surface of the chin rest. Excessive pressure is encouraged in particular by the fact that, with known chin rests, the player does not receive any haptic feedback on how much pressure he exerts. Therefore, a resilient behaviour of the contact surface should be created, so that it shifts with higher pressure. Tests have shown that a springy behaviour leads to a surprise for the player, which requires a new balance. This automatically leads to a reduction in pressure. Therefore a spring element should be provided between the connecting elements of the holding element. In addition, a springy behaviour of the holding device also provides an acoustic decoupling between the bearing surface and the string instrument, so that the sound is also considerably improved.

The holding device can be made in one piece with the support plate, for example as a moulded part moulded onto it. Alternatively, the holding device and the support plate can be two separate components which are connected to each other by means of suitable fasteners, such as a screw or adhesive joint.

Advantageous embodiments of the invention are the subject of the dependent claims.

Advantageously, the holding device comprises a spring element. For the type of the spring element, basically the most different mechanisms can be used, e.g. spiral springs, repelling magnets mechanically fixed on top of each other, a massive mould made of plastic or rubber etc. However, a particularly weight-saving design that can be realised with very little effort is possible, as the spring element is advantageously designed in the manner of a leaf spring. Leaf or flat springs usually consist of a bent strip of a hard-elastic material.

In advantageous design, the spring element of the holding device is made in one piece. This results in a particularly simple production and assembly.

In a particularly advantageous design, the spring element consists of a strip of material which is bent or curved in its central area and is bent at its two end areas in such a way that the spring element forms an oval interrupted on one of its longitudinal sides in longitudinal section. Such a design offers a particularly simple configuration in the manner of a flat spring. The connections to the body of the string instrument can be made, for example, through simple holes in the legs of the U, through which screws are suitably guided. An alternative and particularly preferred method of connection, however, is a system of clamp elements which can be connected to the spring element by means of a click mechanism.

The spring element can be made of various suitable materials, e.g. steel, carbon fibre or thermoplastic material. However, in a particularly advantageous design, each of which is considered to be independently inventive, the spring element is made of plastic, preferably nylon, particularly preferably provided with glass fibres, or alternatively of wood, in particular compressed compressed wood, preferably maple wood. Surprisingly, a spring element made of these materials has significantly improved sound characteristics compared to other materials and does not influence the sound of the string instrument. It has been found, quite surprisingly, that both of the above materials are, in terms of their acoustic or tonal characteristics, particularly suitable for their intended use in a chin rest, since their respective vibration characteristics are particularly well compatible with the vibration characteristics of the body of the instrument.

In the alternative design, which is also regarded as independently inventive, the material used for the holding device is compressed compressed wood, which has equally good sound characteristics. It also turned out that the wood of the spring should preferably be cut in rind or tangential cut. This makes it particularly suitable for being bent strongly and for withstanding constant pressure.

The manufacture and some of the properties of compressed compressed wood, generally also referred to as "compressed wood", are known, for example, from EP 2 002 759 A1, the disclosure of which is incorporated by reference with regard to the definition and manufacturing process of compressed compressed wood. In particular, in the manufacture of compressed wood, a very carefully selected solid wood starting material, which has a moisture content of, for example, about 50 to 60%, is first dried under natural environmental conditions to a moisture content of about 30%, then cut and smoothed, and further dried to a moisture content of about 20%. It can then be subjected to the actual compression process. For this, i.e. the actual compression process, the wood block to be treated is first subjected to a heat treatment, in particular to soften it appropriately. Afterwards, the thus pretreated wood block is subjected to hydrostatic pressure in the actual compression chamber. This causes the wood fibres to be compressed in the direction of their fibres, so that the fibre walls are brought into a fold. This makes the wood in its overall shape bendable and malleable. Immediately after compression, the treated wood may exhibit a curvature or deformation of the entire wood block due to treatment. In order to compensate for this, a bending or shaping step can be provided subsequently to give the wood block back its straight shape, which is favourable for further processing.

In a particularly advantageous embodiment, the spring element is between 7 and 25 mm wide in cross-section, preferably between 9 and 15 mm, particularly preferably between 10 and 12 mm, the minimum width in cross-section being advantageously between 2 and 15 mm, preferably between 3 and 10 mm, particularly preferably between 4 and 7 mm. Furthermore, the spring element is preferably between 1 and 4 mm thick. Furthermore, the spring element is advantageously between 1 and 7 cm high and/or between 4 and 12 cm long. In these dimensions a spring element is particularly suitable for placement between the instrument and the player's chin, so that a natural posture is guaranteed. It also has particularly suitable spring forces.

In particular, the spring element has a spring constant of between 0.8 and 18 N/mm, preferably between 1.2 and 14 N/mm, especially preferably between 1.4 and 12 N/mm. Such spring constants lead particularly well to the desired effect of avoiding too much pressure by the player on the chin rest.

In addition, the spring element advantageously exhibits a directional torque between 0.16 and 4.8 Nm/rad, preferably between 0.24 and 4 Nm/rad, particularly preferably between 0.28 and 3.6 Nm/rad. These values produce a comparable force on the player's chin if the point of application is not directly above the spring but offset by a few cm by the contact surface.

Experiments have shown that the margins mentioned above meet the needs of players of different experience levels who require different levels of resistance. For example, a player who already uses little force can play with a spring constant of 4 N/mm or a directional torque of 0.8 Nm/rad. An inexperienced musician will rather start with 12 N/mm or 2.4 Nm/rad. Such a player will then have the opportunity to get used to the new playing method step by step.

If compressed compressed wood is used for the spring element, this has an advantageous density between 0.6 g/cm3 and 0.96 g/cm3. In terms of sound, weight and elasticity, such compressed wood is particularly suitable for use in a spring element in a chin rest.

The holding device as described before is advantageously used to connect a string instrument to a support surface designed to support the chin of the player of the string instrument.

A chin rest for a string instrument, comprising a support surface adapted to receive the chin of the player of the string instrument, advantageously comprises a holding device as previously described.

A string instrument advantageously includes such a chin rest.

The advantages achieved by the invention consist in particular in the fact that the use of a resilient holding device in a chin rest of a string instrument ensures on the one hand a particularly good sound of the instrument and on the other hand prevents the player from cramping. Especially in the design of a spring element made of bent compressed compressed wood or of nylon, especially in the particularly preferred design equipped with glass fibres, these advantages can be realised in a technically particularly simple way.

Furthermore, such a design fulfils the wish for higher chin rests, which has existed for more than 10 years. This has to do with the search for healthier ways to play such string instrument. It is also increasingly preferred to use a lower shoulder support and a higher chin rest in return. Unfortunately, higher chin rests are usually also much heavier, which affects the tone. The inventive concept makes it possible to produce models with very high pitch with only a very slight increase in weight. A conventional chin rest easily may weigh 65 grams, a high version 85 grams. On the other hand, a chin rest according to the invention as described here can weigh 15 grams, with a high version weighing at most 1 gram more.

In addition, the spring element according to the invention ensures a particularly good sound: if you play a violin and remove your head from the chin rest, you can hear that the violin sounds freer. The head dampens the violin sound indirectly through the chin rest. The chin rest described here frees the violin from this effect.

The spring decouples the head from the violin because it is flexible and gives the violin a certain independence.

The chin rest described here is made up of three main parts that are interchangeable: Mounting, spring and chin rest. The spring can be replaced if the player wants to use a spring with different characteristics; the attachments can easily be adapted to a particular violin without having to change the model of the chin rest.

Also significant is the possibility of using chin rests of different shapes. These can even be offered by third parties and/or 3D-printed according to personal measurements. This makes it possible to customise a chin rest to suit your personal requirements. The chin rest can also be flexibly adjusted individually by turning and tilting. Hereby the position can be adjusted exactly to the cheekbone.

Figure 2:
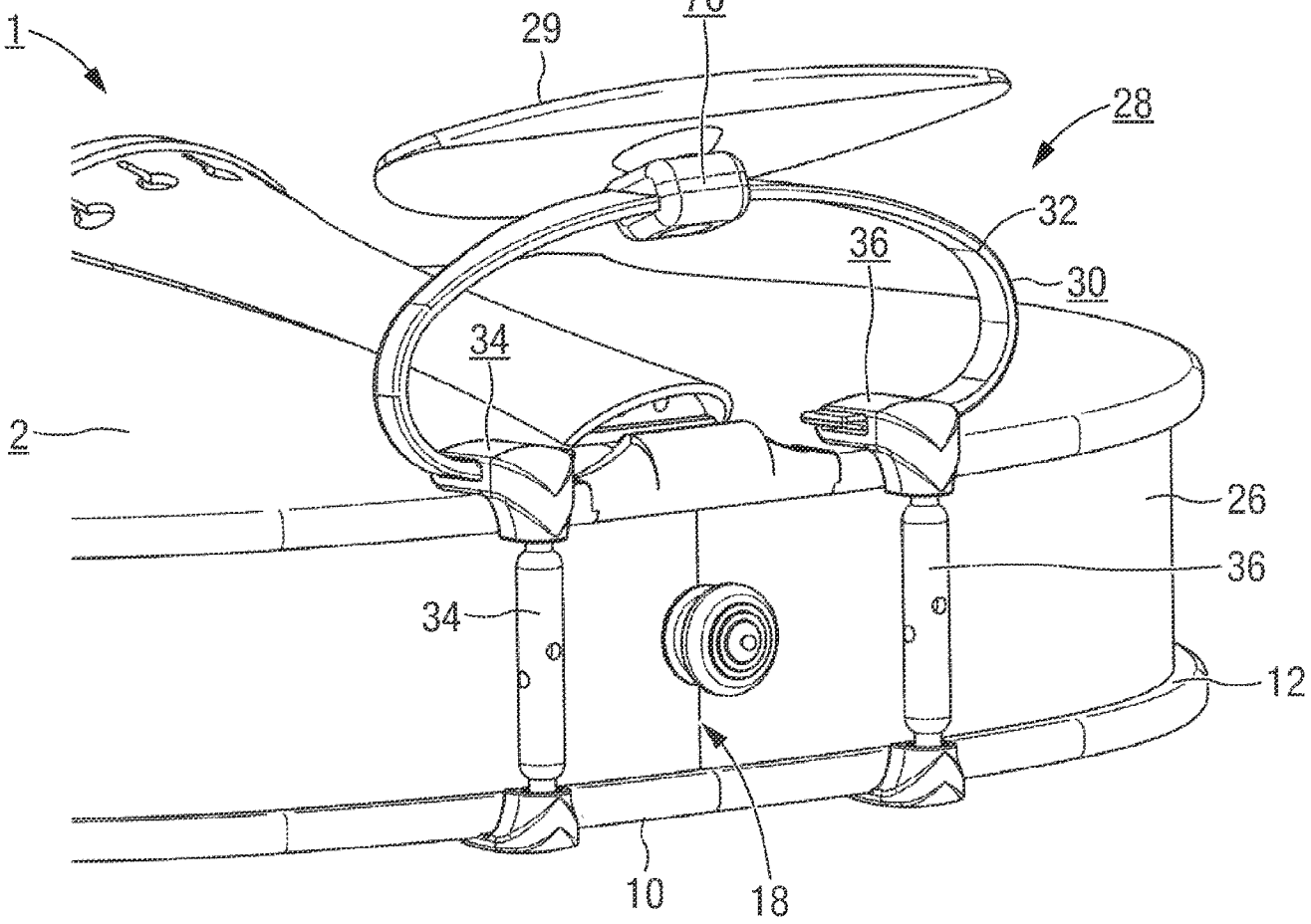
Figure 13A:
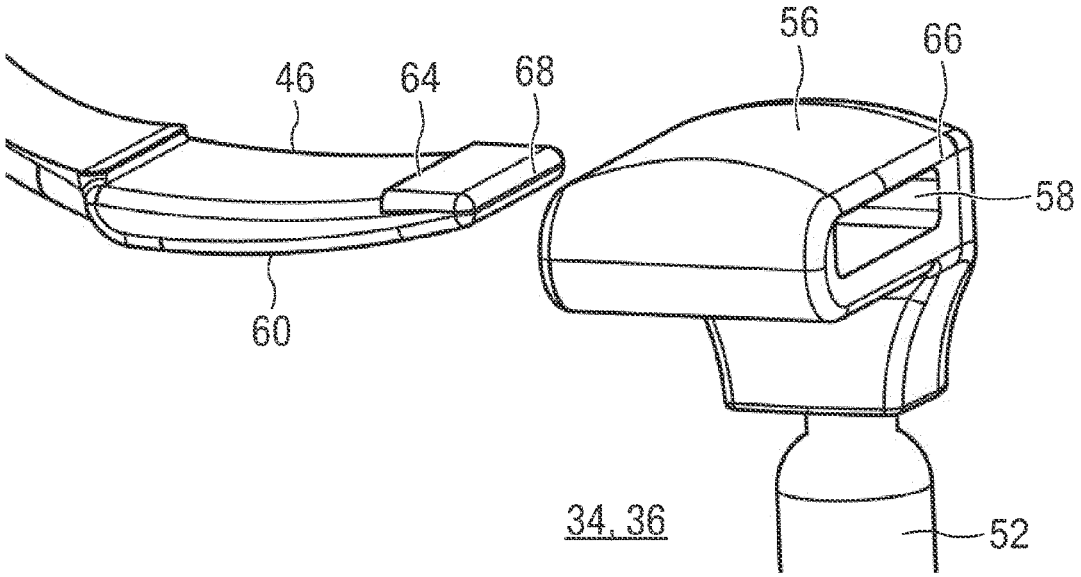
Figure 13B:
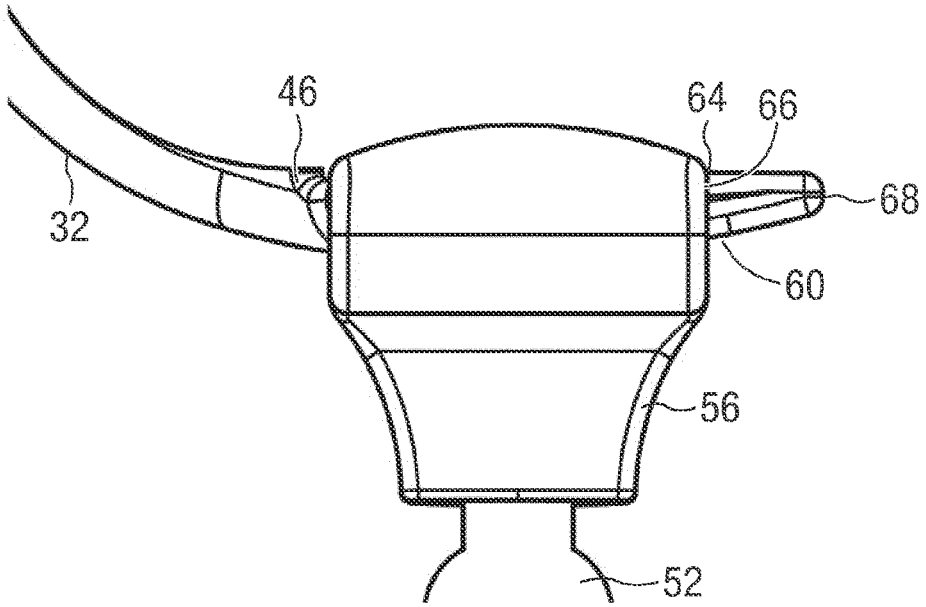
Figure 14:
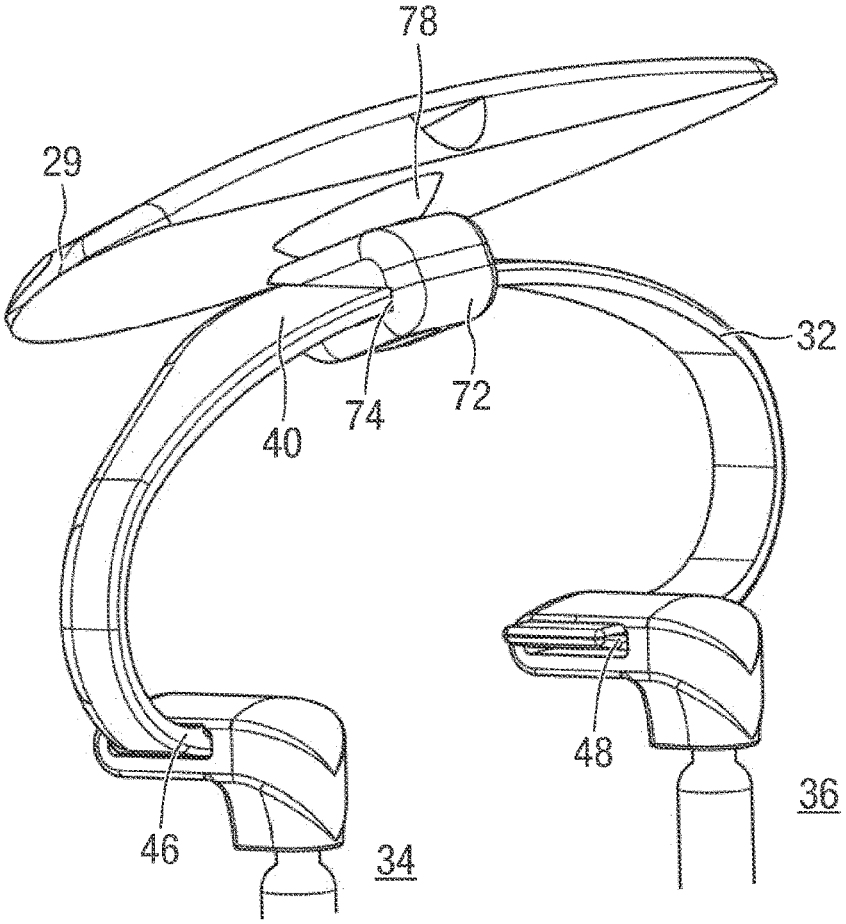

An example of the invention is explained in detail by means of a drawing. Show it:

FIG. 1 a string instrument, here a violin,

FIG. 2 a perspective view of the lower part of the body of the violin, the chin rest of which is fixed with a holding device, FIG. 3-7 different views of the spring element of the holding device according to FIG. 2, FIG. 8-12 different views of the spring element of the holding device according to FIG. 2 with assigned clamp elements, FIG. 13 a click mechanism to connect the spring element according to FIG. 3-7 with the assigned clamp elements in an enlarged view, FIG. 14 the attachment of a support plate of the violin to the spring element according to FIGS. 3-7, and FIG. 15 a holding block of the fastening according to FIG. 14 in enlarged representation.

Identical parts are marked with the same reference numerals in all figures.

A classical violin 1, shown in FIG. 1 in bottom view, comprises a body 2, which forms the resonance body, a neck 4, on which a fingerboard is mounted, and a pegbox with pegs 6, the end of which is formed by a scroll 8. The body 2 has a bottom 10 and a surrounding bottom edge 12. At the neck end 14 of body 2 the neck 4 of violin 1 is connected to body 2 via the upper end block 16. Other blocks, which serve to stabilise the violin 1, are worked into the body 2.

At the lower end block 18 the strings of violin 1 are strung by means of a tailpiece end on the upper side of violin 1. The lower end block 18 is therefore very stable and firmly incorporated into the body 2. The upper end block 16, which carries the neck 4 and the fingerboard, is also very stable and firmly worked into the body 2. Nowadays, the upper end block 16 and the neck 4 are usually made separately and glued together in order to provide the necessary carrying properties as well as sound and vibration characteristics.

Side walls, so-called frames 26, are attached to the sides of the bottom 10 of the body 2 in the area of the surrounding bottom edge 12, and a top panel is then attached to these frames 26 opposite the bottom of the body. These parts essentially form the body 2, which forms the resonance chamber of violin 1, and are stabilised with the aid of the so-called outer blocks and the upper and lower end blocks 16, 18.

When playing the violin 1, it is usually clamped between the chin and shoulder or collarbone in the area of the lower end block 18 and held by the musician with one hand on its neck 4. In order to provide the musician with a comfortable and cramp-free posture when playing the violin 1 while maintaining the high sound quality of the violin 1, a so-called chin rest 28 is arranged in the area of the lower end block 18. Among other things, this is intended to at least partially bridge the free space between the player's chin and shoulder/chest and thus allow the violin 1 to be fixed in the chin area in a relaxed manner. Such a chin rest 28 of violin 1 is shown in a lower view in FIG. 2. The chin rest 28 comprises a support plate 29, on which the player can rest his chin when playing the violin 1, and a holding device 30, via which the support plate 29 is attached to the body 2 of the violin 1.

The holding device 30, which is shown in FIG. 2 in the assembled state attached to the body 2, is specifically designed to enable the player to adopt a particularly favourable ergonomic position while maintaining a particularly high sound quality when playing the violin 1. The design of the holding device 30 takes particular account of the fact that it is desirable to keep the pressure exerted on the support plate 29 of the chin rest 28 to a minimum in order to improve the player's posture ergonomically. To this end, the restraint 30 is designed to generate a resilient behaviour of the support plate 29 in response to pressure exerted by the player, so that the player receives haptic feedback on this as a result of the pressure exerted on the support plate 29. Such resilient behaviour should in fact lead to a surprise for the player, which requires a new balance and thus automatically leads to a reduction in pressure. The holding device 30 therefore comprises a spring element 32, to which the support plate 29 is mounted on the one hand, and which is fastened to the body 2 by means of a number of clamp elements 34, 36—two in the embodiment shown.

The characteristic properties of the spring element 32, i.e. in particular its spring constant and its stroke, are preferably designed specifically for the intended purpose, namely to provide the player with haptic feedback as a result of pressure exerted on the chin rest 28. The spring element 32 in the embodiment shown has a spring constant between 1 and 8 N/mm with a stroke of 5 mm.

The equipment of the holding device 30 with the spring element 32, which is considered to be essential for the invention, can be achieved on the one hand by a suitable choice of material for the holding device 30 and/or on the other hand by the chosen spatial shape of the spring element 32, preferably the design in the manner of a leaf spring. Both approaches, i.e. the design of the spring element 32 by a suitable choice of material and the design of the spring element 32 by a suitable three-dimensional shape, are each considered to be independently inventive; however, the embodiment shown shows the combination of both approaches which is also considered to be independently inventive.

Figure 3:
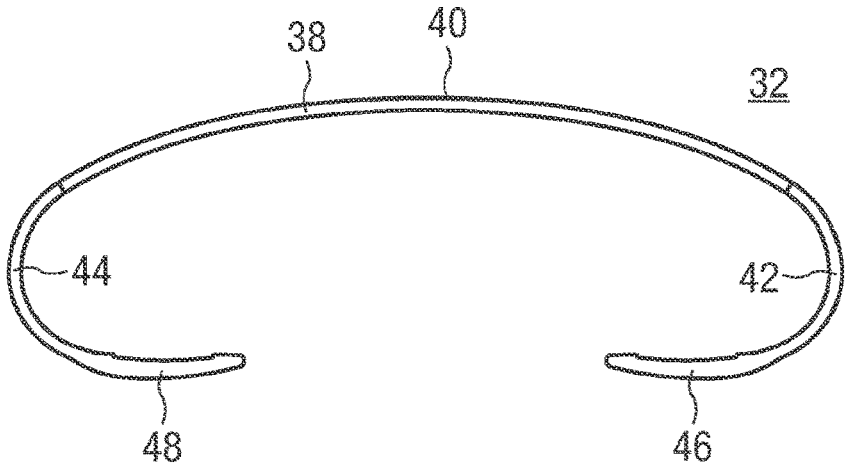
Figure 4:
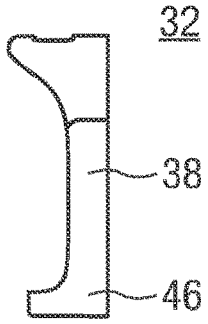
Figure 5:
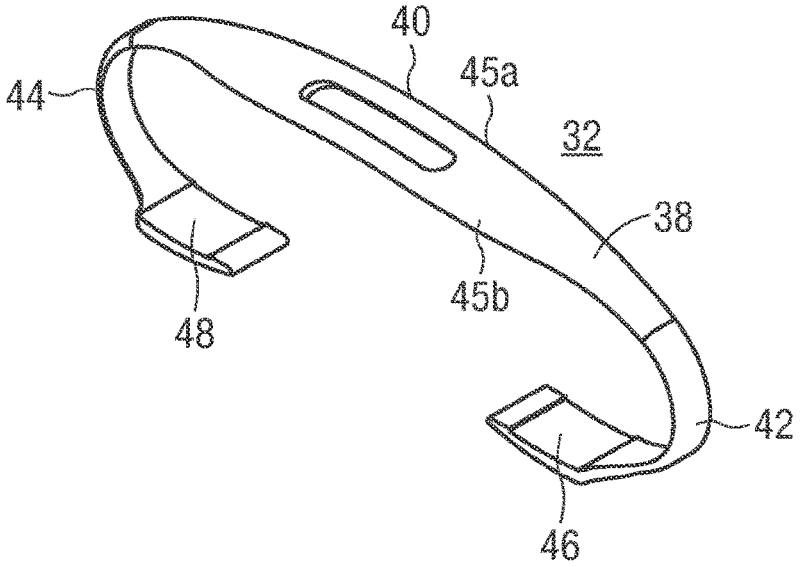
Figure 6:
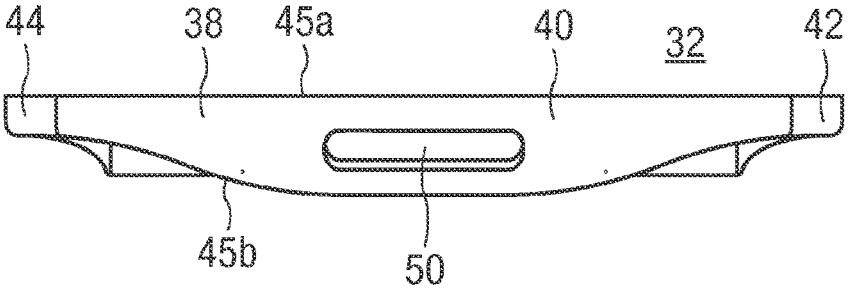
Figure 7:
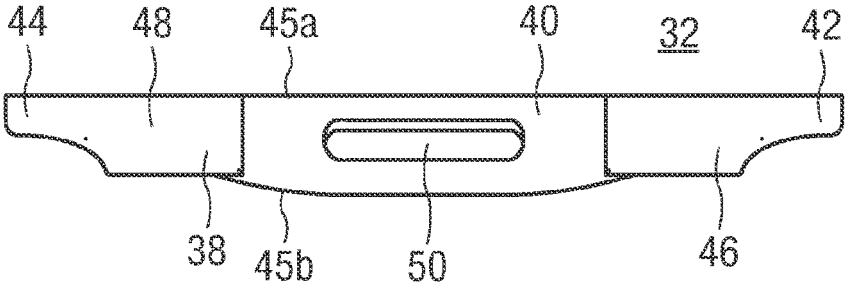
Figure 8:
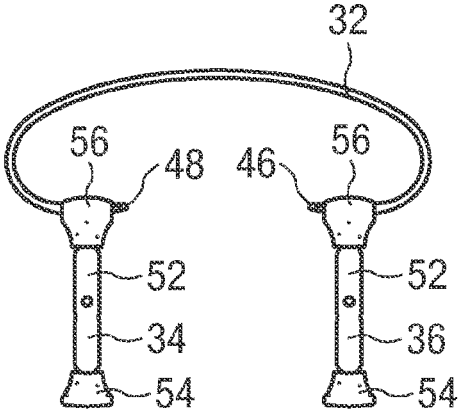
Figure 9:
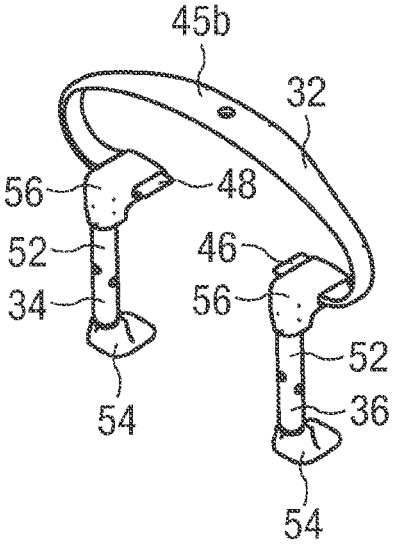
Figure 10:
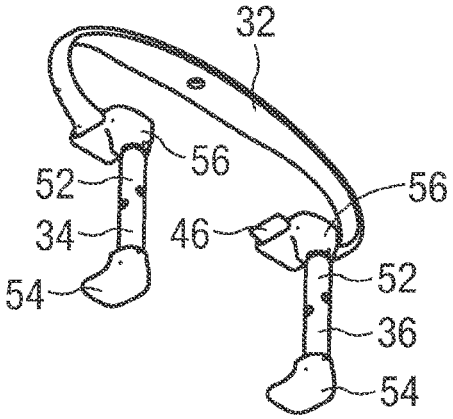
Figure 12:
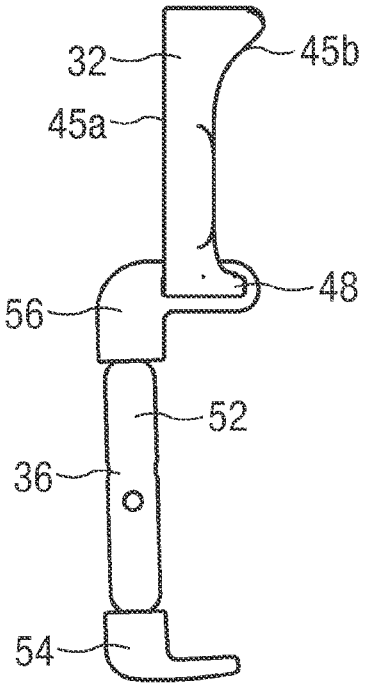
Figure 11:
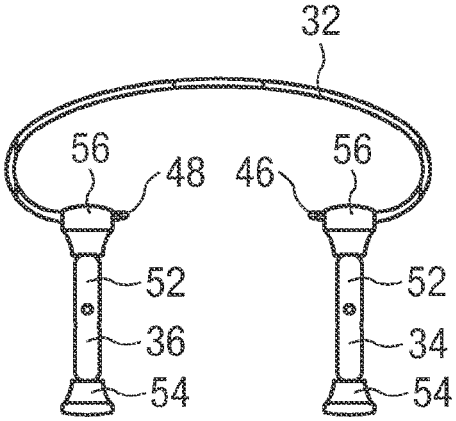

A particularly preferred embodiment shown for the spatial design of the spring element 32 is shown in FIGS. 3 to 7, namely in FIG. 3 in front view, in FIG. 4 in side view, in FIG. 5 in perspective view, in FIG. 6 in top view and in FIG. 7 from below.

The spring element 32 in the embodiment shown is made in one piece according to FIG. 3 to 7. In order to provide the desired spring properties, the spring element 32 in the embodiment shown is designed in a particularly suitable spatial form, which in terms of its functionality comes close to the properties of a leaf spring. The one-piece spring element 32 essentially consists of a strip of material 38, which is slightly bent or curved in its central area 40 and bent by almost 180° at its two end areas 42, 44. As can be seen particularly clearly from the illustration in FIG. 3, the spring element 32 thus forms an oval interrupted on one of its long sides in longitudinal section.

On its central area 40, which forms the continuous long side of this oval, as well as on the end foot areas intended for connection with the clamp elements 34, 36, the material strip 38 is widened, as is particularly clear from the top view in accordance with FIG. 6. In these areas, it has a maximum width of 7 to 25 mm, preferably between 9 and 15 mm, especially preferably between 10 and 12 mm, in a particularly preferred embodiment shown. On the other hand, the width is reduced in the end transition zones of the central area 40, where it merges into the end areas 42, 44; in these areas, the material area in the embodiment shown has a particularly preferred minimum width of between 2 and 15 mm, preferably between 3 and 10 mm, particularly preferred between 4 and 7 mm.

As can be seen particularly clearly from the top view in FIG. 6, the contoured design of the material strip 38 forming the spring element 32, i.e. the thickening in the central area 40, is not symmetrical to the longitudinal central axis of the material strip 38. On the contrary, the contouring of the material strip 38, which is considered to be independently inventive, is designed in such a way that the first edge 45*a*, which in the assembled state of the spring element 32 faces backwards, i.e. towards the player of violin 1, is essentially straight. The contouring is achieved by a contoured design of the second edge 45*b*, which in the assembled state of the spring element 32 is designed to face forwards, i.e. towards the neck 4 of violin 1. The result of this design is that the contouring has the effect of a deliberate weakening, which makes it easier to tilt the spring element 32 towards the neck 4 and more difficult to tilt the spring element 32 towards the player. This means that the player can be supported particularly effectively by the spring element 32, since in any case a secure hold of the instrument 1 is ensured and at the same time a particularly sensitive reaction to pressure exerted by the player (this pressure acts primarily in the direction of the neck 4).

To fix the support plate 29, the central area 40 is also provided with a mounting slot 50, through which, for example, a fixing screw provided for the installation of the support plate 29 can be passed and—due to the slot-shaped design—in the longitudinal direction of the central area 40 can be positioned according to the needs of the player. In the preferred design shown, the material strip 38 has a thickness between 0.5 and 4 mm.

In addition, the spring element 32 is made of a material considered to be particularly suitable for providing the desired spring characteristics. In particular, the spring element 32 or the material strip 38 forming it can be made of a suitably selected metal or plastic, preferably nylon or nylon 6.6, particularly preferably mixed with glass fibres.

In an alternative embodiment, which is also considered to be independently inventive, the material strip 38 is made of compressed wood. In contrast to e.g. pressboard, which is made of compressed wood chips, compressed wood is characterised in particular by the fact that it is made of solid wood. The compressed wood has a density of about 0.7 g/cm3. In other embodiment shows it can have a density between 0.6 and 0.96 g/cm3. In this type of production the spring is not pressed into shape, but the pressed wood is produced and cut into boards, and from these boards shaped bodies are cut, which are bent around a corresponding shape after they have been dried in the oven.

The material strip 38 in the embodiment shown is suitably adapted to the intended use with violin 1 in terms of its dimensions, with appropriate consideration of the desired spring properties with the material selection specified above. In the embodiment shown it is in a spring steel version with a maximum width of between 5 and 10 mm, preferably between 6 and 9 mm, particularly preferably between 7 and 8 mm, and has a thickness of 0.5 to 1.5 mm. The minimum width in this version is preferably between 2 and 9 mm, preferably between 2.5 and 8 mm, particularly preferably between 3 and 7 mm. In a wood or plastic version, however, the maximum width is between 7 and 25 mm, preferably between 9 and 15 mm, particularly preferably between 10 and 12 mm, and has a thickness of 1 to 4 mm. In this version, the minimum width is preferably between 2 and 15 mm, preferably between 3 and 10 mm, particularly preferably between 4 and 7 mm.

To fix the spring element 32 to the body 2, the holding device 30 has the clamp elements 34, 36 as connecting elements. These can be connected to the foot sections 46, 48 of spring element 32 and can be attached to the body 2 of violin 1. A particularly preferred example of the design of the clamp elements 34, 36 attached to the spring element 32 is shown in FIGS. 8 to 12, namely in FIG. 8 in front view, in FIG. 9 in perspective view from above, in FIG. 10 in perspective view from below, in FIG. 11 in rear view and in FIG. 12 in side view.

As can be seen in FIGS. 8 to 12, the clamp elements 34, 36 each have an intermediate rod 52, on which a retaining foot 54 and a retaining head 56 are arranged at each end. A contact surface for the body 2 is moulded onto each of these, whereby the dimensions of the components mentioned are selected so that the body 2 with body bottom and body top can be inserted, in particular clamped, between the contact surfaces of the retaining foot 54 and retaining head 56 and fixed there.

The retaining head 56 of each clamp element 34, 36 is designed and suitably shaped for connection to one of the foot sections 46, 48 of spring element 32. Such a connection could, for example, be made in the form of a screw connection. In the particularly preferred design shown in the example and considered to be an independently inventive design, however, a so-called "click" connection is provided as the connection, in which the foot areas 46, 48—which are designed as flat surfaces—can be inserted into a corresponding slot 58 in the retaining head 56. This is shown in FIG. 13 in the state immediately before insertion (FIG. 13*a*) and after locking (FIG. 13*b*).

The foot areas 46, 48 have a slightly curved back 60 and a snap-in edge 64 adjacent to a contact surface 62. When the respective foot areas 46, 48 are inserted into the receiving slot 58, the foot area 46, 48 is temporarily slightly deformed within the receiving slot 58 and bent outwards (against the curvature of the back 60) due to this design and the material-related elasticity of the spring element 32. After the latching edge 64 has emerged from the receiving slot 58, it springs back due to the spring force and forms a hook with the outlet end face 66 of the receiving slot 58. It thus forms a detachable snap or latch connection of the spring element 32 with the respective retaining head 56. In this way, a reliable attachment of the spring element 32 to the clamp elements 34, 36 is made possible with particularly simple means, but without tools. This snap-in or snap-on connection can be released in a particularly simple way, in particular, by manually pressing the free end 68 of the foot section 46, 48, which protrudes from the locating channel 58, against the spring force in the direction of the back 60, so that the catch between the catch edge 64 and the end face 66 is released.

The attachment of the support plate 29 to the spring element 32 is specifically designed to allow the support plate 29 to be tilted in all directions as far as possible even when assembled, thus giving the player a particularly large degree of freedom in adapting to his own wishes and requirements. In order to take this into account, a connecting system 70 is provided with which the support plate 29 is mounted on the spring element 32. As can be seen from the illustration in FIG. 14, the connecting system 70 comprises a holding block 72, which has a receiving slot 74 for the central area 40 of the spring element 32. The dimensions of the slot 74, especially the width of the slot, are adapted to the spring element 32, especially its thickness.

Figure 15:
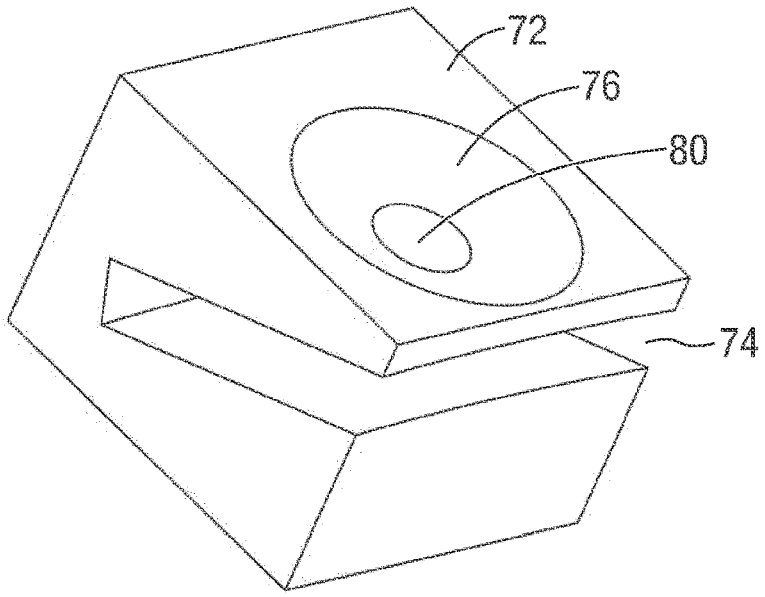

The holding block 72, shown in perspective in FIG. 15, has a receiving slot 76 on its upper side in the form of a spherical surface segment, into which a corresponding ball joint part 78, attached to the underside of the supporting plate 29, can be inserted. This design ensures that the support plate 29 can be swivelled in almost all directions. To connect all elements with each other, a connecting screw can be provided, which is passed through the mounting slot 50 in the spring element 32 and through a screw channel 80 in the holding block 72 and engages in the corresponding thread in the area of the ball joint part 78.

The spring constant defined by the spring element 32 in the embodiment shown is approx. 4 N/mm. Depending on the geometrical conditions and the elasticity of the material strip 38, the spring constant can be between 0.8 and 18 N/mm. This produces a force of between 0.4 kg and 9 kg, preferably between 0.6 kg and 7 kg, and particularly preferably between 0.7 kg and 6 kg, when a vertical load is applied with a displacement of 5 mm.

Furthermore, the holding device 30 in the embodiment shown, which is equipped with spring element 32, has a directional torque of 0.8 Nm/rad. The directional torque is the constant of proportionality between the angle of twist of the spring element 32 and the torque generated by it. In other embodiment shows, the directional torque can be between 0.16 and 4.8 Nm/rad. This ensures that the corresponding counterforces are also achieved if the point of action is not directly above the spring by the bearing surface 29, but offset by a few cm. With a directional moment described above, it is achieved that a force between 0.2 and 6 kg, preferably between 0.4 and 5 kg, is generated at a displacement of 5 mm for a vertical load that is offset by 2 cm.

As shown in FIG. 2, the holding element 30 is used in a chin rest 28, i.e. it is used to connect a support plate 29 for the chin of the player of violin 1 with the body 2 of violin 1. Due to the arrangement shown, the holding device 30 acts resiliently between the support plate 29 and violin 1, so that a cramped position of the player exerting too much pressure is avoided and at the same time a particularly good sound of the violin 1 is achieved.

LIST OF REFERENCE SIGNS

1 violin
2 body
4 neck
6 swivels
8 scroll
10 bottom
12 bottom edge
14 neck ends
16, 18 end block
20,22 outer block
24 curvature
26 frame
28 chin rest
29 support plate
30 holding device
32 spring element
34,36 clamp element
38 material strips
40 central area
42,44 end range
45*a*, 45*b* edge
46,48 foot area
50 mounting slot
52 intermediate rod
54 retaining foot
56 holding head
58 slot
60 back
62 contact surface
64 snap-in edge
66 front surface
68 free end
70 connection system
72 holding block
74 slot
76 receptacle
78 ball joint part
80 screw channel

The invention claimed is:

1. A holding device for a chin rest for a string instrument, via which a support plate provided for placing the chin of the player of the string instrument on it can be connected to the body of the string instrument, the holding device comprising:

a spring element for a resilient connection of the support plate to the body, said spring element including a strip of material which is bent or curved in its central region and is bent over at its two end regions in such a way that in longitudinal section the spring element forms an oval interrupted on one of its longitudinal sides.

2. The holding device according to claim 1, the spring element of which is formed from a plastic, of a metal or of compressed pressed wood.

3. The holding device according to claim 2, wherein the compressed wood has a density between 0.6 g/cm3 and 0.96 g/cm3.

4. The holding device according to claim 1, the spring element of which is between 2 and 25 mm wide and/or between 1 and 4 mm thick in cross-section.

5. The holding device according to claim 1, the spring element of which is contoured and is designed with a width which varies as viewed in the longitudinal direction of the strip (of material, the maximum width in cross-section being between 7 and 25 mm, preferably between 9 and 15 mm, particularly preferably between 10 and 12 mm, and the minimum width in cross-section being between 2 and 15 mm, preferably between 3 and 10 mm, particularly preferably between 4 and 7 mm.

6. The holding device according to claim 1, the spring element of which is between 1 and 7 cm high and/or between 4 and 12 cm wide.

7. The holding device according to claim 1, the spring element of which has a spring constant of between 0.8 and 18 N/mm, preferably between 1.2 and 14 N/mm, particularly preferably between 1.4 and 12 N/mm.

8. The holding device according to claim 1, the spring element of which has a directional torque of between 0.16 and 4.8 Nm/rad, preferably between 0.24 and 4 Nm/rad, particularly preferably between 0.28 and 3.6 Nm/rad.

9. A use of a holding device in accordance with claim 1 for connecting a string instrument to a support plate, designed to support the chin of the player of the string instrument.

10. A chin holder for a string instrument, comprising a support plate adapted to support the chin of the player of the string instrument, and a holding device according to claim 1.

11. A string instrument having a chin rest according to claim 10.

12. The holding device according to claim 2, the spring element of which is between 2 and 25 mm wide and/or between 1 and 4 mm thick in cross-section.

13. The holding device according to claim 2, the spring element of which is contoured and is designed with a width which varies as viewed in the longitudinal direction of the strip (of material, the maximum width in cross-section being between 7 and 25 mm, preferably between 9 and 15 mm, particularly preferably between 10 and 12 mm, and the minimum width in cross-section being between 2 and 15 mm, preferably between 3 and 10 mm, particularly preferably between 4 and 7 mm.

14. The holding device according to claim 2, the spring element of which is between 1 and 7 cm high and/or between 4 and 12 cm wide.

15. The holding device according to claim 2, the spring element of which has a spring constant of between 0.8 and 18 N/mm, preferably between 1.2 and 14 N/mm, particularly preferably between 1.4 and 12 N/mm.

16. The holding device according to claim 2, the spring element of which has a directional torque of between 0.16 and 4.8 Nm/rad, preferably between 0.24 and 4 Nm/rad, particularly preferably between 0.28 and 3.6 Nm/rad.

17. A use of a holding device in accordance with claim 2 for connecting a string instrument to a support plate, designed to support the chin of the player of the string instrument.

18. A chin holder for a string instrument, comprising a support plate adapted to support the chin of the player of the string instrument, and a holding device according to claim 2.

19. A string instrument having a chin rest according to claim 18.

* * * * *